United States Patent [19]

Bartlett et al.

[11] Patent Number: 4,782,552

[45] Date of Patent: Nov. 8, 1988

[54] UPRIGHT VACUUM CLEANER

[75] Inventors: William L. Bartlett, Santa Barbara; David A. Weir, Santa Ynez, both of Calif.

[73] Assignee: Riccar America Company, Tustin, Calif.

[21] Appl. No.: 77,626

[22] Filed: Jul. 24, 1987

[51] Int. Cl.[4] ..... A47L 5/34

[52] U.S. Cl. ..... 15/333; 15/354; 15/360; 15/361; 15/410

[58] Field of Search ..... 15/333, 354, 360, 361, 15/410

[56] References Cited

U.S. PATENT DOCUMENTS

| | | | |
|---|---|---|---|
| 2,174,595 | 10/1939 | Pierce | 15/333 |
| 2,644,976 | 7/1953 | Osborn | 15/333 |
| 2,686,331 | 8/1954 | Humphrey | 15/333 |
| 2,724,140 | 11/1955 | Daiger et al. | 15/333 |
| 3,416,181 | 12/1968 | Nordeen . | |
| 3,579,699 | 5/1971 | Balzer | 15/361 |
| 3,676,892 | 7/1972 | Nordeen | 15/359 |
| 3,854,164 | 12/1974 | Schmitz | 15/340 |
| 3,908,223 | 9/1975 | Brooks et al. | 15/361 |
| 4,217,674 | 8/1980 | Hayashi | 15/361 |
| 4,446,594 | 5/1984 | Watanabe et al. | 15/333 |

*Primary Examiner*—Philip R. Coe
*Assistant Examiner*—Corinne M. Reinckens
*Attorney, Agent, or Firm*—Lyon & Lyon

[57] ABSTRACT

There is disclosed herein an upright vacuum cleaner comprising a main body having a suction opening, and a handle body pivotally attached to the main body. A relatively simple cam, which may be made from sheet metal in the form of a box, is disposed in the main body and pivoted with respect thereto. The cam is engaged by a cam actuator of the handle body when the handle body is moved to its upright vertical position to cause the cam to pivot in a manner to raise the suction opening of the main body from the rug or carpet.

4 Claims, 2 Drawing Sheets

UPRIGHT VACUUM CLEANER

The present invention relates to vacuum cleaners, and more particularly to upright vacuum cleaners including a main body having a suction opening for picking up material from a floor surface and having a handle body pivoted to and extending from the main body.

BACKGROUND

Various forms of upright vacuum cleaners have been developed over the years. U.S. Pat. Nos. 4,217,674, 3,854,164, 3,676,892, and 3,416,181 show several forms of upright vacuum cleaners. Upright vacuum cleaners include a suction opening in the lower part of the main body, and the suction opening normally includes a rotatable brush and/or beater adjacent thereto. The cleaner has a handle or bag body which is pivotally mounted to the main body and the former houses the dust bag into which dust and dirt are directed. Vacuum cleaners of this type sometimes are left in an upright position wherein the suction opening and brush assembly remain in contact with a floor, rug or the like even though the cleaner is not moved back and forth for cleaning. This usually occurs when either (a) the vacuum cleaner is in an idle condition while the user is involved in some other activity, such as moving an article of furniture, or (b) when a vacuum hose and suction attachments are connected to the vacuum cleaner, as when cleaning a sofa or draperies. If the vacuum cleaner is allowed to remain in this state for a prolonged period of time, the rotary brush assembly can damage the rug or floor and, also, the motor of the vacuum cleaner may become overheated because of the continual obstruction of the suction opening. The latter can result in damage to the main body housing as well as the motor.

Various attempts have been made to obviate these problems, and have involved providing some mechanism for raising the suction opening from the rug or floor during such conditions of operation. U.S. Pat. No. 4,216,674 noted above particularly addresses this problem and also refers to U.S. Pat. Nos. 3,676,892 and 3,854,164. U.S. Pat. No. 4,216,674 describes a conventional prior construction in reference to FIG. 5 thereof which uses a pivoting lever and points out the complex and unreliable construction thereof. The arrangement proposed in U.S. Pat. No. 4,216,674, while apparently different from prior constructions involves a design wherein the main body and handle body are provided with a cooperative pivoting arrangement to generate a "seesaw" type action to raise the suction opening from the floor or carpet when the handle body is in its upright position.

SUMMARY

On the other hand, in accordance with the concepts of the present invention and a preferred embodiment thereof, a relatively simple but sturdy pivoting plate or cam box assembly is provided and which preferably is attached to and pivoted on the main body. As the handle body is moved to and from the upright position the cam box moves and engages the floor surface to cause the suction opening to be lifted from the rug or floor in a very simple and efficient manner.

Accordingly, it is an object of the present invention to provide an improved vacuum cleaner construction.

An additional object of this invention is to provide a relatively simple and sturdy cam lever box assembly for an upright vacuum cleaner and which causes the suction opening of the vacuum cleaner to be raised from the carpet or floor when the vacuum cleaner is in an idle condition.

BRIEF DESCRIPTION OF DRAWINGS

These and other objections and features of the present invention will become better understood through a consideration of the following description taken in conjunction with the drawings in which.

DETAILED DESCRIPTION

Figure 1:
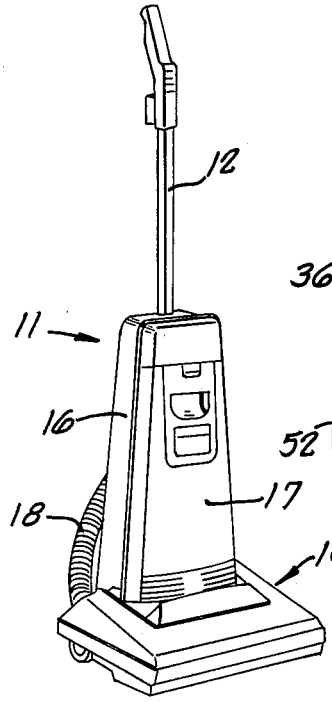
FIG. 1 is a perspective view of an upright vacuum cleaner of the typical prior art type and which incorporates the concepts of the present invention.

Turning now to the drawings, and first FIG. 1, the same illustrates an upright vacuum cleaner having a main body 10 and a handle body or bag housing 11 pivoted to the main body. The handle body 11 has a handle 12 extending therefrom. The main body 10 houses a suitable motor (not shown) for driving a fan to provide the suction and for driving a typical brush assembly 14 which will be discussed subsequently. The handle body 11 is in the form of an elongated box or container 16 with a cover 17 and within which is arranged a conventional dust bag as is well known. A hose 18 conveys dust and dirt from the main body to the dust bag in the handle body 11 in a conventional manner.

The main body 10 includes an upper housing 20 and a bottom cover 21 secured thereto, as by screw fasteners 23–24, in a conventional manner. Similarly, the cover 21 has a usual suction opening 26 formed by openings **26*a* and 26*b* in the bottom cover 21. The brush assembly 14 is rotatably mounted in the body 10 and driven by the motor as noted earlier, and the brush typically includes conventional brushes and beater bars. The handle body 11 is suitably pivotally mounted as indicated at 30 to the main body 10**. The construction thus far described is conventional, and is basically the same as that of upright vacuum cleaners sold in the United States by Riccar America Co. of Tustin, California, such as their Model 2,000.

Figure 2:
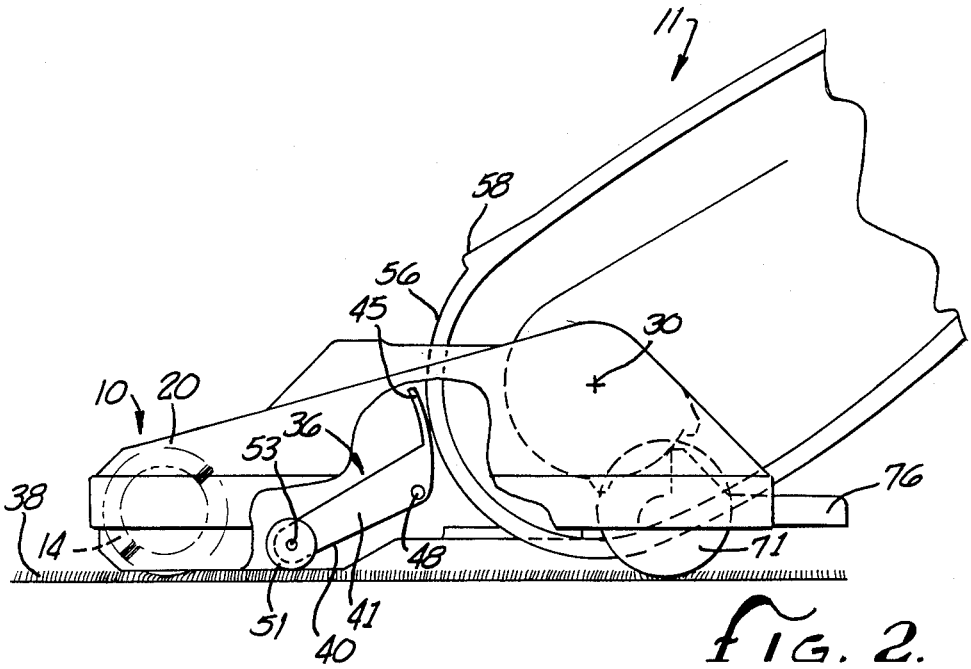
FIG. 2 is a partially broken away side view of the vacuum cleaner according to the present invention in normal operation for cleaning a floor surface.
Figure 3:
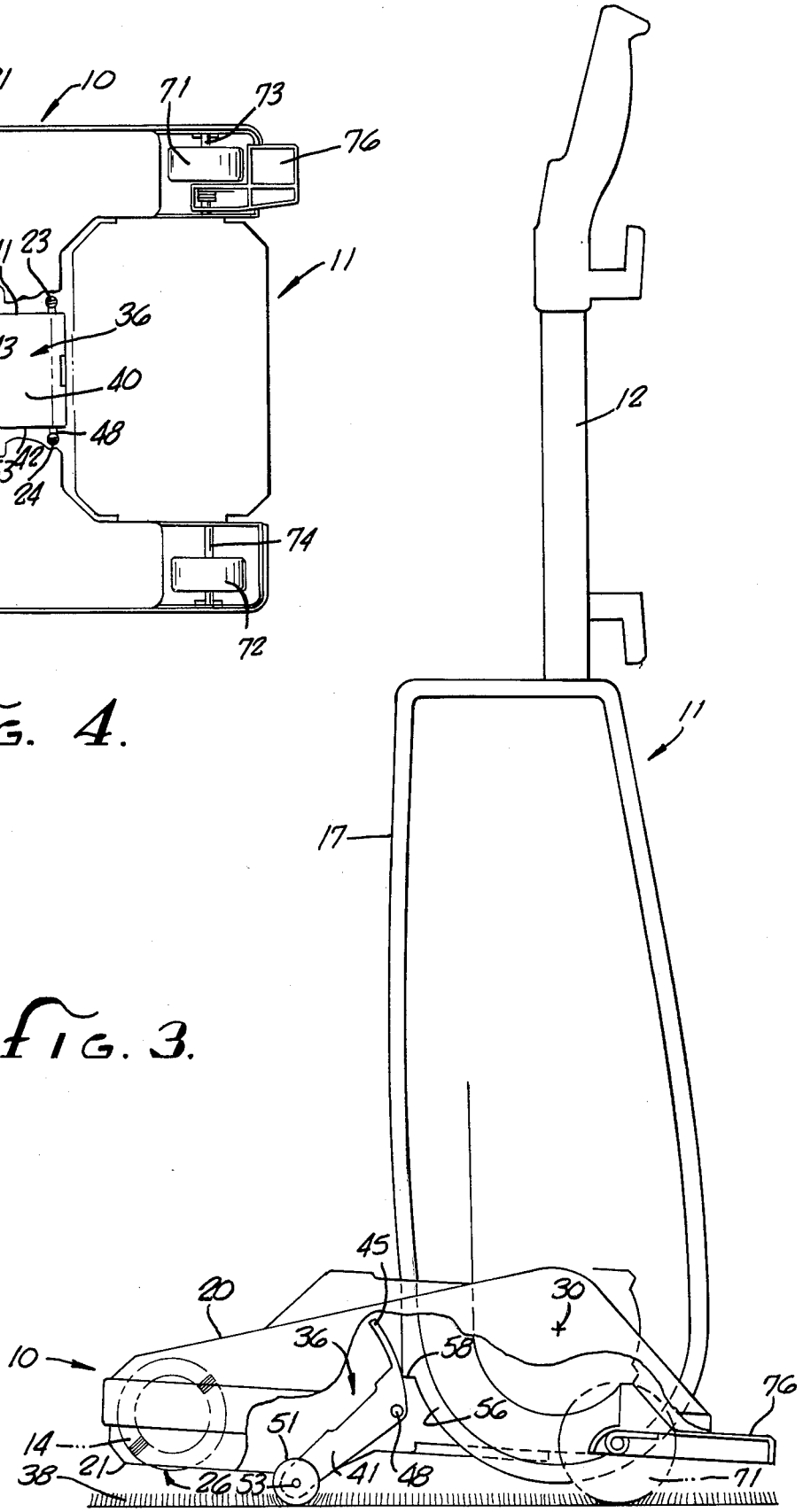
FIG. 3 is a partially broken away side view of the vacuum cleaner, similar to the view of FIG. 2, but with the handle body of the vacuum cleaner in an upright position and, thus, in an idle condition.

In accordance with the present invention, and a preferred embodiment thereof, the vacuum cleaner includes a cam box assembly which functions to raise the suction opening 26 off of a carpet or floor 38 when the handle body 11 is raised to its upright vertical position as shown in FIG. 3, but allows the suction opening 26 to engage the rug or carpet 38 when the handle body is moved away from the upright vertical position of FIG. 3, such as to the position shown in FIG. 2, during normal operation of the vacuum cleaner.

Figure 5:
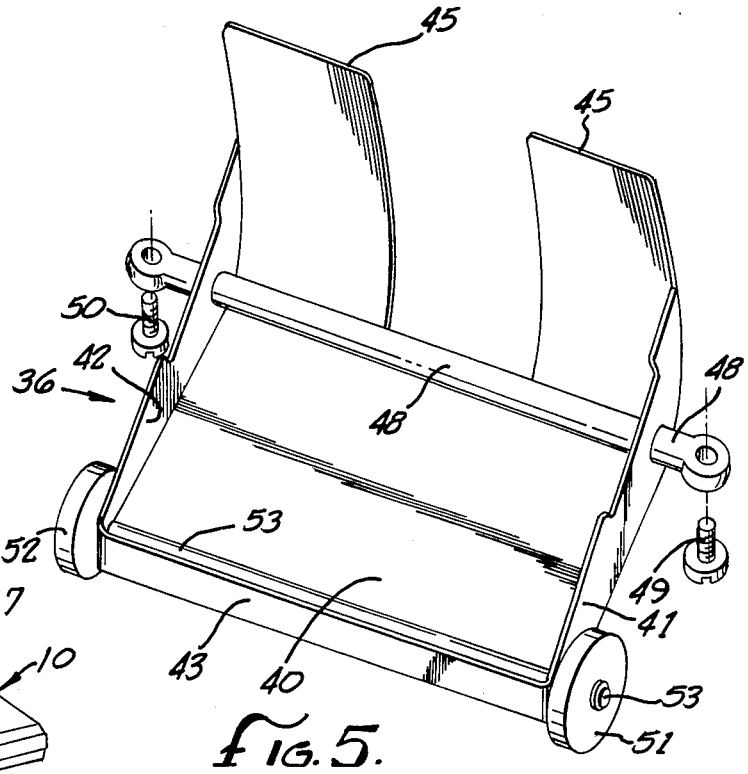
FIG. 5 is a perspective view of a cam box assembly of the present invention.
Figure 4:
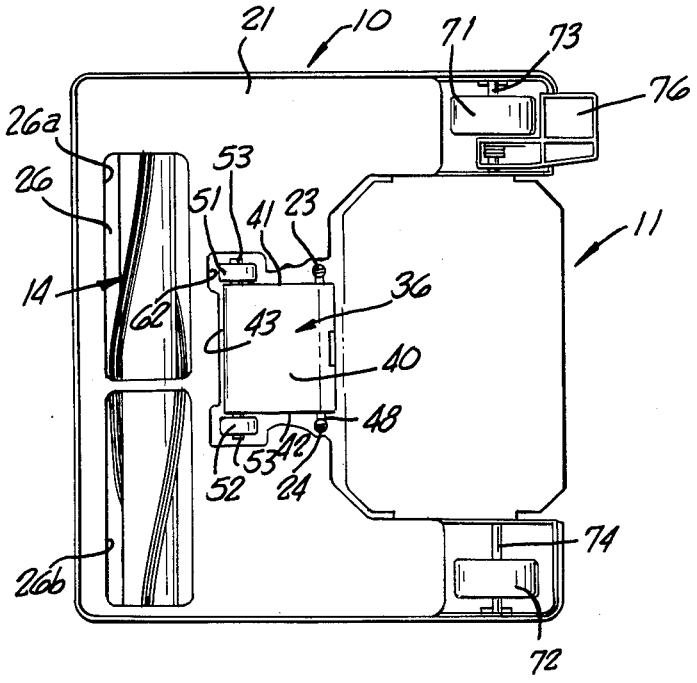
FIG. 4 is a bottom view of the vacuum cleaner of FIGS. 1–3.

The cam box 36 is a simple and inexpensive pivoting box assembly which can be formed out of sheet metal to form a sturdy box construction having a base, sides and ends. The cam box 36 comprises a base 40 (note particularly FIGS. 4 and 5), a pair of sides 41 and 42 extending upwardly from the base 40, a front end 43 and a back end forming an arcuate cam 45. The cam 36 further includes a cylindrical axle 48 extending through the sides 41 and 42, the ends of which are suitably attached to and secured within the upper housing 20 of the main body 10 as by screws 49–50. Thus, the cam box 36 is free to pivot about the axle 48. The forward end 43 of the cam 36 includes a pair of rollers 51 and 52 which may be mounted on a common shaft 53 which extends through the sides 41–42. The bottom plate 21 of the main body 10 includes a suitable opening 62 through which the wheels 51–52 and the forward end 43 of the cam 36 can extend when raising the suction opening 26 from the floor 38 as shown in FIG. 3. The forward and lower side 56 of the handle body 11 has an outwardly extending projection formed therein providing a cam actuator 58.

As the handle body 11 is moved to the vertical position as shown in FIG. 3, the cam actuator 58 engages the rear face of the cam 45, thereby pushing against the rear face and pivoting the cam 36 counterclockwise as viewed in FIG. 3. This action causes the wheels 51–52 to move downwardly and engage the carpet or floor 38 to thereby raise the suction opening 26 off the floor as seen in FIG. 3.

As the handle body 11 is moved away from the upright vertical position of FIG. 3 toward the operating position of FIG. 2, the cam actuator 58 moves away from (as seen in FIG. 2) and disengages from the cam face 45, allowing the cam box 36 to pivot or rotate in a clockwise direction, thereby allowing the wheels 51–52 to move up and away (because of the weight of the main body 10, which moves down) sufficiently from the floor 38 to enable the suction opening 26 to normally engage the floor for cleaning.

The cam box 36, operated in conjunction with the cam actuator 58, is an extremely simple and sturdy device for accomplishing the objective of raising the suction opening 26 from the floor. The cam 36 can be formed of relatively few parts. The bottom 40, sides 41–42, end 43 and cam end 45 can be formed of a single piece of suitable metal such as steel in the box construction as seen in the drawings, and the only other components required are the axle 48 for securing the assembly to the main body 10, and the wheels 51–52 and axle 53 therefor.

The main body 10 additionally includes a pair of suitable wheels 71–72 mounted on respective shafts 73–74 in the rear of the main body 10 for facilitating gliding of the vacuum cleaner over the rug or floor 38. A conventional handle body release pedal 76 also is provided and is attached to the main body 10, and engages the lower portion of the handle body 11 in a conventional manner to maintain the same in the upright position shown in FIG. 3. Depression of the pedal 76 allows the handle body 11 to be pivoted downwardly toward the position shown in FIG. 2 for operation of the vacuum cleaner.

Although a preferred embodiment of the present invention has been shown and described, it will be apparent to those skilled in the art that various modifications and variations can be made without departing from the inventive concepts disclosed herein and, therefore, the invention is to be accorded the full scope of the appended claims.

What is claimed is:

1. An upright vacuum cleaner comprising a main body having a body housing and a cover, a suction opening provided in the cover of the main body through which dust and dirt can be picked up from a floor surface to be cleaned, a handle body pivotally mounted to the main body and being movable to various positions including inclined positions normally used during cleaning and an upright position, said handle body having a surface adjacent the main body with a projection thereon forming a cam actuator, and cam lever means pivotally mounted with respect to said main body and including a cam face engageable by said cam actuator, said cam lever means having floor contacting means for extending through the cover of said main body for engaging a floor surface for raising the suction opening from the floor surface when the handle body is moved to its upright position, said cam lever means having a cam body formed of sheet metal substantially in the form of a box and having a base, sides extending upward from the base, and the cam face extending upwardly from the base.

2. The vacuum cleaner as in claim 1 wherein said floor contacting means comprises a pair of wheels rotatably mounted on the cam lever means, and said cam body is formed from one piece of sheet metal, and shaft means extending through said sides of cam lever means and being attached to said body housing of said main body.

3. A vacuum cleaner having a main body, a suction opening in said main body, a handle pivotally mounted to said main body, and a means for raising said suction opening when said handle is raised to an upright vertical position, said means for raising comprising:

a pivoting box assembly having a base, sides extending upward from said base, a back end forming an arcuate cam extending upward from the base, a front end with a floor contacting means, and an axle between said front end and said back end, secured to said main body, and extending through said sides, wherein said pivoting box assembly pivots about said axle and a cam actuator comprising an outwardly extending projection on a forward and lower side of said handle for engaging said arcuate cam.

4. A vacuum cleaner as in claim 3 wherein said floor contacting means comprises a pair of wheels rotatably mounted on said pivoting box assembly.

* * * * *